US010045614B2

(12) United States Patent
Chou

(10) Patent No.: US 10,045,614 B2
(45) Date of Patent: Aug. 14, 2018

(54) ASSEMBLED REPLACEABLE FRAME STRUCTURE

(71) Applicant: Guang-Rui Chou, New Taipei (TW)

(72) Inventor: Guang-Rui Chou, New Taipei (TW)

( * ) Notice: Subject to any disclaimer, the term of this patent is extended or adjusted under 35 U.S.C. 154(b) by 0 days.

(21) Appl. No.: 15/132,247

(22) Filed: Apr. 19, 2016

(65) Prior Publication Data

US 2016/0345726 A1 Dec. 1, 2016

(30) Foreign Application Priority Data

May 28, 2015 (TW) ..... 104117148 A

(51) Int. Cl.
*A47B 47/00* (2006.01)
*A47B 57/00* (2006.01)
*A47B 96/20* (2006.01)

(52) U.S. Cl.
CPC ..... *A47B 47/0091* (2013.01); *A47B 47/00* (2013.01); *A47B 57/00* (2013.01); *A47B 2096/209* (2013.01)

(58) Field of Classification Search
CPC . A47B 47/00; A47B 47/0016; A47B 47/0041; A47B 47/0091; A47B 57/00; A47B 57/08; A47B 57/10; A47B 2096/20; A47B 2096/201; A47B 2096/209; A47B 47/009; H05K 7/12; H05K 7/18
USPC ..... 220/4.01, 4.28, 4.33; 312/108, 111, 312/265.1–265.5
See application file for complete search history.

(56) References Cited

U.S. PATENT DOCUMENTS 3,570,801 A * 3/1971 Moritz ..... B28B 7/0014 220/4.33
3,697,363 A * 10/1972 Martinez ..... A47B 95/00 312/204
3,748,009 A * 7/1973 Stone ..... F16B 12/125 312/108
3,847,460 A * 11/1974 Weidt ..... A47B 47/04 312/111
4,662,107 A * 5/1987 Van Den Kieboom .. A47G 7/06 47/84
5,921,647 A * 7/1999 Schneider ..... A47B 47/05 312/108
7,866,769 B2 * 1/2011 Ahlgrim ..... A47B 47/0041 312/108
9,125,492 B1 * 9/2015 Kane ..... A47B 47/05
9,198,306 B1 * 11/2015 Feinstein ..... A47F 3/00
2013/0264924 A1 * 10/2013 Tusk ..... A47B 47/0041 312/265.4

(Continued)

FOREIGN PATENT DOCUMENTS

| | | |
|---|---|---|
| CN | 2434235 | 6/2001 |
| TW | M499522 | 4/2015 |
| TW | M513623 | 12/2015 |

OTHER PUBLICATIONS

"Office Action of Taiwan Counterpart Application," dated Jun. 30, 2017, p. 1-p. 4, in which the listed references were cited.

*Primary Examiner* — Bryon Gehman
(74) *Attorney, Agent, or Firm* — JCIPRNET

(57) ABSTRACT

An assembled frame structure including a hollow frame and a plurality of covers is provided. The hollow frame has a plurality of first assembling openings. The covers are detachably assembled to the hollow frame through the first assembling openings respectively, so as to form the assembled frame structure into a multi-function package module.

9 Claims, 6 Drawing Sheets

(56) References Cited

U.S. PATENT DOCUMENTS

2014/0263299 A1* 9/2014 Marschall ..... B65D 21/02
220/4.01

* cited by examiner

ASSEMBLED REPLACEABLE FRAME STRUCTURE

CROSS-REFERENCE TO RELATED APPLICATION

This application claims the priority benefit of Taiwan application serial no. 104117148, filed on May 28, 2015. The entirety of the above-mentioned patent application is hereby incorporated by reference herein and made a part of this specification.

BACKGROUND OF THE INVENTION

Field of the Invention

The invention relates to a frame structure and more particularly relates to an assembled frame structure.

Description of Related Art

In everyday life, it is common to put things on tables, shelves or in containers. Since such tables, shelves, or containers have fixed outer shapes and are difficult to be combined together, it may not be possible to change their structural states for different purposes. As people have diverse requirements for arrangement of house layout and other places, furniture or equipment that has fixed outer shapes and monotonous appearance may no longer satisfy such requirements.

SUMMARY OF THE INVENTION

The invention provides an assembled frame structure which is easy to assemble/disassemble and is highly flexible for assembly.

The invention provides an assembled frame structure which includes a hollow frame and a plurality of covers. The hollow frame has a plurality of first assembling openings. The covers are detachably assembled to the hollow frame through the first assembling openings respectively, so as to form the assembled frame structure into a multi-function package module.

In an embodiment of the invention, at least one of the covers has at least one second assembling opening. The assembled frame structure further includes at least one plug-in. The plug-in is detachably assembled to the corresponding cover through the second assembling opening.

In an embodiment of the invention, the hollow frame includes a plurality of first engaging parts located in the first assembling openings. Each cover includes a plurality of second engaging parts. When each cover is detachably assembled to the hollow frame through the corresponding first assembling opening, the second engaging parts of the each cover are respectively engaged with the first engaging parts located in the corresponding first assembling opening.

In an embodiment of the invention, the hollow frame includes a plurality of magnetic sensitive members located in the first assembling openings. Each cover includes a plurality of magnetic members. When each cover is detachably assembled to the hollow frame through the corresponding first assembling opening, the magnetic members of the each cover respectively attract the magnetic sensitive members located in the corresponding first assembling opening.

In an embodiment of the invention, the hollow frame includes a plurality of magnetic members located in the first assembling openings. Each cover includes a plurality of magnetic sensitive members. When each cover is detachably assembled to the hollow frame through the corresponding first assembling opening, the magnetic sensitive members of the each cover are respectively attracted to the magnetic members located in the corresponding first assembling opening.

In an embodiment of the invention, each cover has a first surface and a second surface opposite to the first surface. When each cover is detachably assembled to the hollow frame through the corresponding first assembling opening, the first surface is hidden in the hollow frame while the second surface is exposed outside the hollow frame.

In an embodiment of the invention, at least one of the covers includes a grip part. The grip part is disposed on the second surface.

In an embodiment of the invention, the second surface of at least one of the covers is printed with text, an image, a symbol, or a mark, or includes a digital display panel.

In an embodiment of the invention, at least one of the covers includes a carrying part. The carrying part is disposed on the second surface.

In an embodiment of the invention, at least one of the covers includes a main part and a covering part connected with the main part. The covering part is adapted to move relative to the main part to expose or cover a receiving space of the main part.

Based on the above, the assembled frame structure of the invention includes the hollow frame as the main body for the user to assemble multiple covers according to his/her needs. Therefore, the assembled frame structure of the invention is easy to assemble/disassemble and is highly flexible for assembly and use.

To make the aforementioned and other features and advantages of the invention more comprehensible, several embodiments accompanied with drawings are described in detail as follows.

BRIEF DESCRIPTION OF THE DRAWINGS

The accompanying drawings are included to provide a further understanding of the invention, and are incorporated in and constitute a part of this specification. The drawings illustrate exemplary embodiments of the invention and, together with the description, serve to explain the principles of the invention.

DESCRIPTION OF THE EMBODIMENTS

Figure 1A:
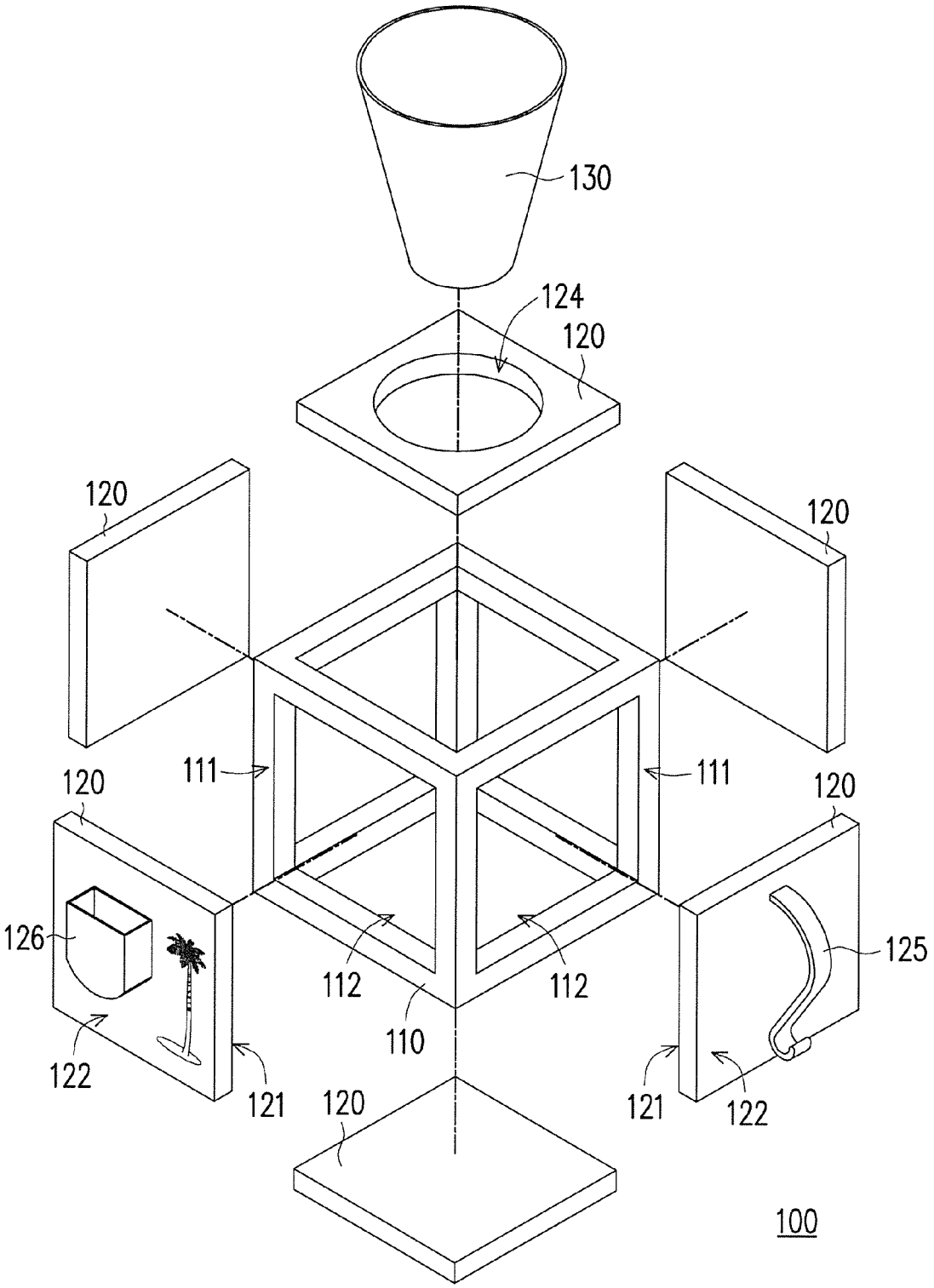
FIG. 1A is an exploded view of the assembled frame structure according to an embodiment of the invention.
Figure 1B:
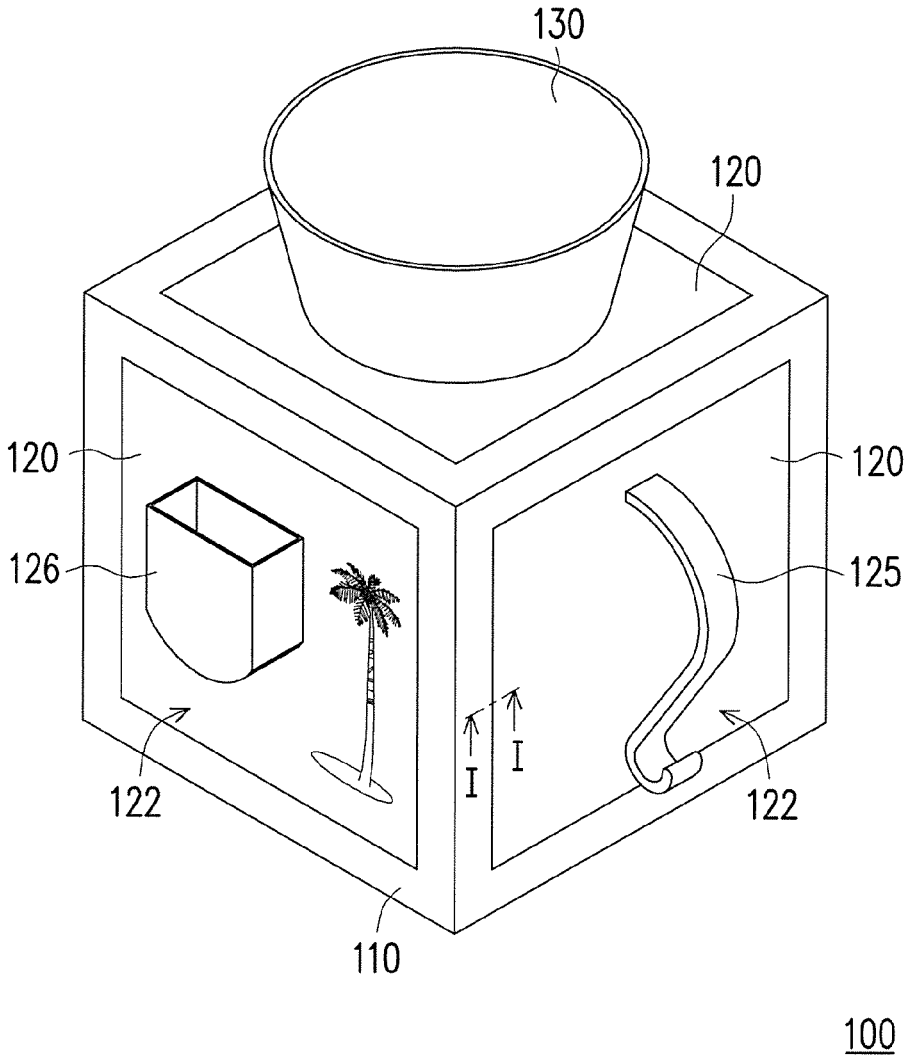
FIG. 1B is an assembled view of the assembled frame structure of FIG. 1A.

FIG. 1A is an exploded view of an assembled frame structure according to an embodiment of the invention. FIG. 1B is an assembled view of the assembled frame structure of FIG. 1A. Referring to FIG. 1A and FIG. 1B, in this embodiment, an assembled frame structure 100 includes a hollow frame 110 and a plurality of covers 120. The hollow frame 110 is a hollow cube, for example, which has at least one first assembling opening 112 on each wall 111. It should be noted that the invention is not intended to limit the shape or form of the hollow frame. In other embodiments, the hollow frame may be a hollow cylinder, a hollow triangular pyramid, a hollow cone, or other hollow polyhedrons. Generally, the hollow frame is formed of metal, acrylic, plastic, glass, a composite material, or other suitable materials.

The hollow frame 110 may serve as a body for placing or carrying an object, and the covers 120 are detachably assembled to the hollow frame 110 through the first assembling openings 112 respectively, so as to form the assembled frame structure 100 into a multi-function package module. For example, the user may assemble the covers 120 that have different functions to the hollow frame 110 according to the operation requirements, or assemble the covers 120 that have different shapes to the hollow frame 110 according to appearance requirements. In addition, since each cover 120 has a contour that approximately matches a contour of the corresponding first assembling opening 112, each cover 120 covers the corresponding first assembling opening 112 after being assembled to the hollow frame 110.

Specifically, each cover 120 has a first surface 121 and a second surface 122 opposite to the first surface 121. When each cover 120 is detachably assembled to the hollow frame 110 through the corresponding first assembling opening 112, the first surface 121 is hidden in the hollow frame 110 while the second surface 122 is exposed outside the hollow frame 110. To enhance the overall appearance after the covers 120 are assembled to the hollow frame 110, the second surface 122 of the cover 120 may be printed with text, an image, a symbol, or a mark. The text, image, symbol, or mark may be designed according to the user's needs for product customization. In addition, the text, image, symbol, or mark may also indicate the use of the assembled frame structure 100 or the covers 120 to be easily recognizable by the user.

Figure 2A:
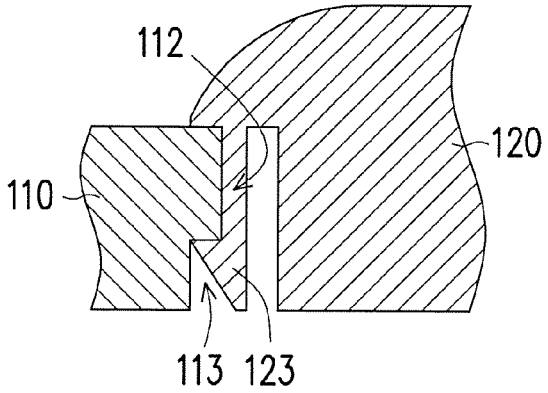
FIG. 2A to FIG. 2C are partial cross-sectional views along the line I-I showing various embodiments of the assembled frame structure of FIG. 1B.
Figure 2B:
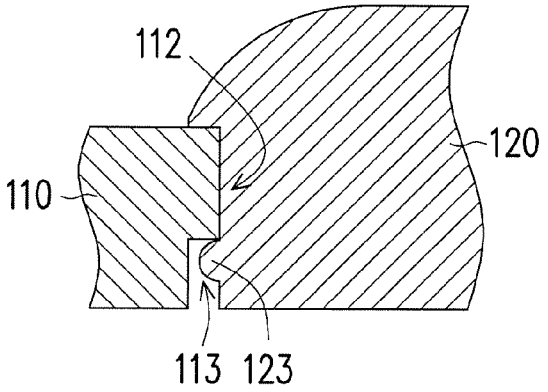
Figure 2C:
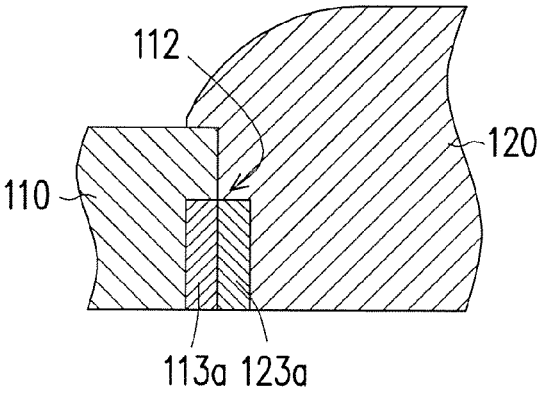

Exemplary methods of assembling the hollow frame 110 and the covers 120 are described hereinafter. FIG. 2A to FIG. 2C are partial cross-sectional views along the line I-I showing various embodiments of the assembled frame structure of FIG. 1B. Referring to FIG. 2A, the hollow frame 110 has a plurality of first engaging parts 113 in the first assembling openings 112. Each cover 120 has a plurality of second engaging parts 123 disposed corresponding to the first engaging parts 113. Here, the first engaging part 113 may be a recess while the second engaging part 123 may be a hook. When each cover 120 is detachably assembled to the hollow frame 110 through the corresponding first assembling opening 112, the hook of each cover 120 is engaged with the recess of the corresponding first assembling opening 120 respectively, such that each cover 120 is firmly assembled to the hollow frame 110.

Referring to FIG. 2B, different from the engagement manner of the cover 120 and the hollow frame 110 shown in FIG. 2A, the second engaging part 123 of the cover 120 in FIG. 2B is a protrusion, for example. Therefore, when each cover 120 is detachably assembled to the hollow frame 110 through the corresponding first assembling opening 112, the protrusion of each cover 120 is engaged with the recess of the corresponding first assembling opening 120 respectively, such that each cover 120 is firmly assembled to the hollow frame 110.

Referring to FIG. 2C, different from FIG. 2A and FIG. 2B in which the cover 120 is fixed to the hollow frame 110 by engaging structures, the hollow frame 110 in FIG. 2C has a plurality of magnetic sensitive members 113*a* in the first assembling openings 112. Each cover 120 has a plurality of magnetic members 123*a* disposed corresponding to the magnetic sensitive members 113*a*. Here, the magnetic sensitive member 113*a* may be an iron plate or a member that is attracted to magnets while the magnetic member 123*a* is a magnet, for example. When each cover 120 is detachably assembled to the hollow frame 110 through the corresponding first assembling opening 112, the magnetic members 123*a* of each cover 120 respectively attract the magnetic sensitive members 113*a* in the corresponding first assembling opening 120, such that each cover 120 is firmly assembled to the hollow frame 110.

Based on the design concept that uses magnetic force to fix the cover 120 to the hollow frame 110, the positions of the magnetic member and the magnetic sensitive member may be switched. That is, the magnetic member is disposed in each first assembling opening of the hollow frame while the magnetic sensitive member is disposed on each cover. Accordingly, when each cover is detachably assembled to the hollow frame through the corresponding first assembling opening, the magnetic sensitive members of each cover are respectively attracted to the magnetic members in the corresponding first assembling opening. Alternatively, magnetic members with different magnetic poles may be respectively disposed on each cover and the corresponding first assembling opening of the hollow frame. Accordingly, when each cover is detachably assembled to the hollow frame through the corresponding first assembling opening, the magnetic members of each cover and the magnetic members in the corresponding first assembling opening attract each other.

In other embodiments, a soft material may be disposed on a side of the cover, wherein the soft material may be rubber or other suitable materials. The soft material is at least disposed on at least one side of the cover, or preferably around the cover. Thus, when the cover is assembled to the opening, the cover is disposed on the opening through the soft material to be fixed to the hollow frame.

Then, referring to FIG. 1A and FIG. 1B, one of the covers 120 may have at least one second assembling opening 124. The assembled frame structure 100 further includes at least one plug-in 130. The plug-in 130 may be detachably assembled to the corresponding cover 120 through the second assembling opening 124. In this embodiment, the plug-in 130 is a cup, for example. The outer peripheral surface of the cup has a contour that matches a contour of the second assembling opening 124. Therefore, when the plug-in 130 is detachably assembled to the corresponding cover 120 through the second assembling opening 124, the plug-in 130 is firmly fixed to the corresponding cover 120 and is not easily detached from the corresponding cover 120 by an external force applied on the hollow frame 110.

In addition, one of the covers 120 around the plug-in 130 may have a grip part 125, such as a handle. The grip part 125 is disposed on the second surface 122 of the corresponding cover 120. The user may use the grip part 125 to take and move the assembled frame structure 100 so as to drink water or a beverage in the cup, for example. It should be noted that the plug-in described in the disclosure is not necessarily a cup. In other embodiments, the plug-in may be a pot or a fish tank, or parts, such as head, hands, and legs, of a doll according to the user's needs or interest.

As shown in FIG. 1B, another cover 120 around the plug-in 130 may have a carrying part 126, such as a bag, a rack, or other members, for storing or carrying an object. The carrying part 126 is disposed on the second surface 122 of the corresponding cover 120. For example, the carrying part 126 may be used to store stationery, tea sets, or other objects required by the user.

Figure 3:
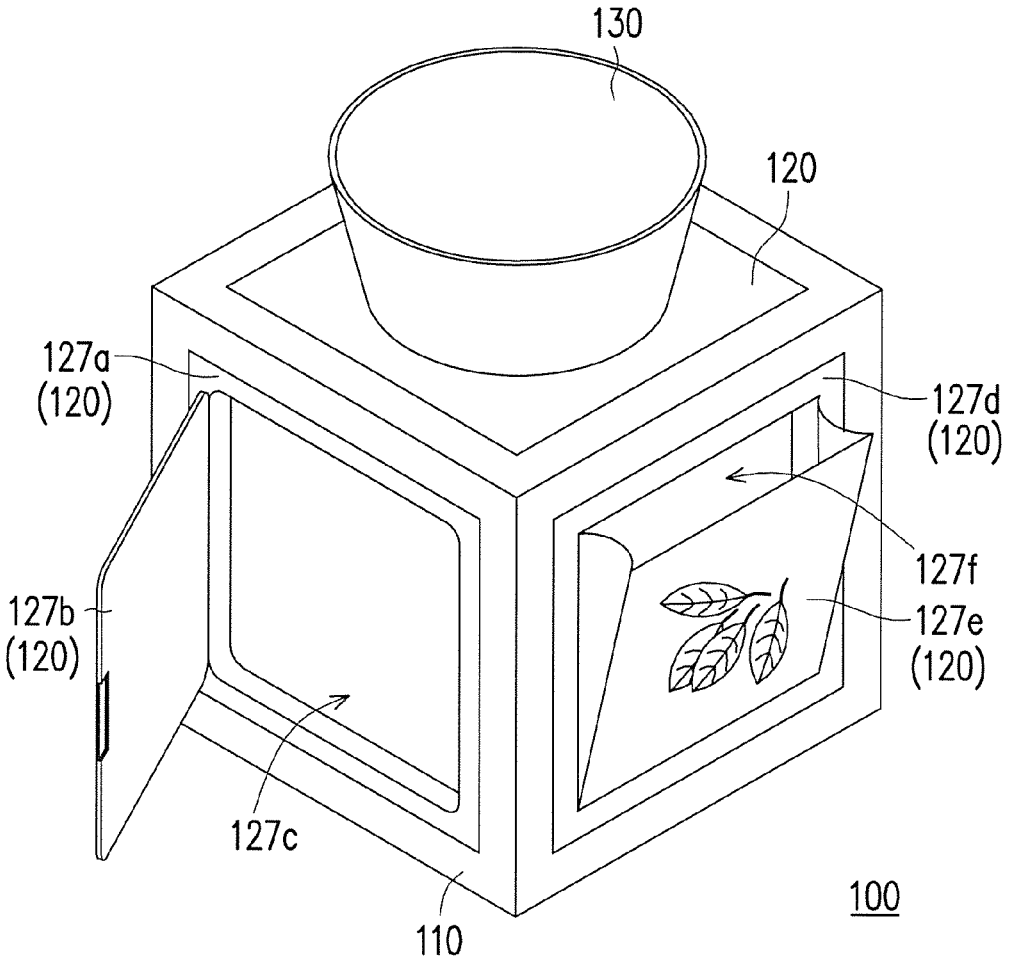
FIG. 3 is a schematic view of the assembled frame structure of FIG. 1B from another aspect.

FIG. 3 is a schematic view of the assembled frame structure of FIG. 1B from another aspect. Referring to FIG.

3, one of the covers 120 around the plug-in 130 includes a main part 127*a* and a covering part 127*b* connected with the main part 127*a*, and another cover 120 includes a main part 127*d* and a covering part 127*e* connected with the main part 127*d*. The covering part 127*b* is pivoted to the main part 127*a* to be rotatable with respect to the main part 127*a*, for example, thereby exposing or covering a receiving space 127*c* of the main part 127*a*. For example, the receiving space 127*c* may store therein stationery, tea sets, or other objects required by the user.

Moreover, the covering part 127*e* is openably connected with the main part 127*d*. As shown in FIG. 3, two opposite sides of the covering part 127*e* are respectively fixed to the main part 127*d* to be separable from the main part 127*d*, and the other two opposite sides connected with the aforementioned two opposite sides are connected with the main body 127*d* through extensible belts, for example. Therefore, when the user applies a force on the covering part 127*e* in a direction away from the hollow frame 110, the covering part 127*e* exposes a receiving space 127*f* of the main part 127*d* for the user to access tea bags or other objected required by the user in the receiving space 127*f*. In addition, when the force applied on the covering part 127*e* is removed, the covering part 127*e* automatically returns to the original position by the extensible belts, so as to cover the receiving space 127*f* of the main part 127*d*.

Some other embodiments of the invention are provided as follows. It should be noted that the reference numerals and a part of the contents in the previous embodiments are used in the following embodiments, in which identical reference numerals indicate identical or similar components, and repeated description of the same technical contents is omitted. Please refer to the description of the previous embodiments for the omitted contents, which will not be repeated hereinafter.

Figure 4A:
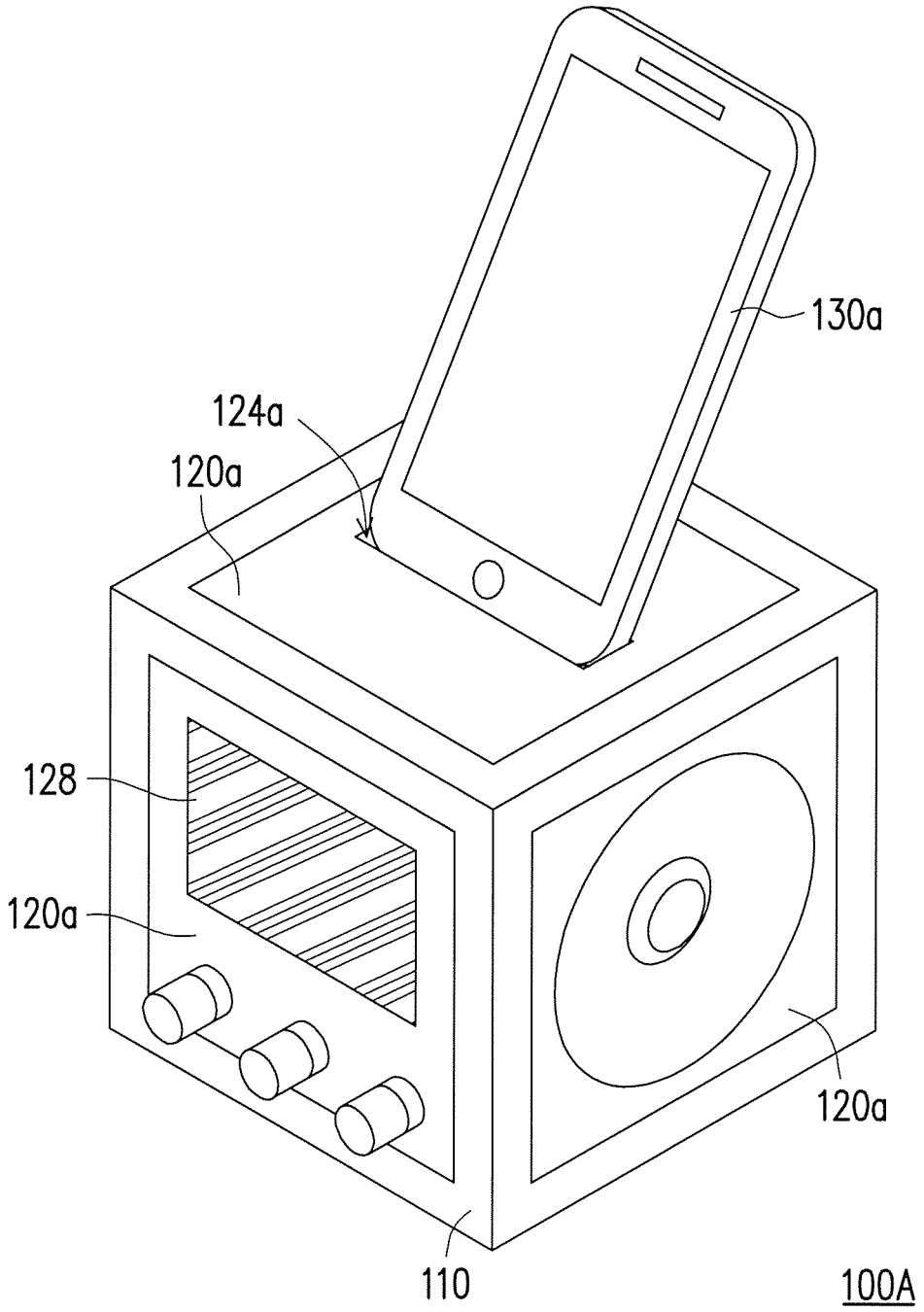
FIG. 4A is an assembled view of the assembled frame structure according to another embodiment of the invention.

FIG. 4A is an assembled view of the assembled frame structure according to another embodiment of the invention. Referring to FIG. 4A, in this embodiment, an assembled frame structure 100A is an external stereo, for example, for playing audio in a smart phone, a tablet computer, or a portable music player plugged in. Specifically, one of the covers 120*a* has at least one second assembling opening 124*a* to serve as a slot for plugging in a plug-in 130*a* (i.e. the smart phone, tablet computer, or portable music player). One of the covers 120*a* around the plug-in 130*a* is a speaker, for example, for playing the audio outputted from the plug-in 130*a* (i.e. the smart phone, tablet computer, or portable music player). Another cover 120*a* around the plug-in 130*a* may have a digital display panel 128 on the second surface 122. Specifically, the covers 120*a* communicate with the plug-in 130*a* (i.e. the smart phone, tablet computer, or portable music player) unidirectionally or bidirectionally by wireless transmission. Moreover, the digital display panel 128 may display related information for the user when the audio is played. For example, the digital display panel 128 may have a touch function for the user to select whether to control the playing through the plug-in 130*a* (i.e. the smart phone, tablet computer, or portable music player) or the digital display panel 128.

Figure 4B:
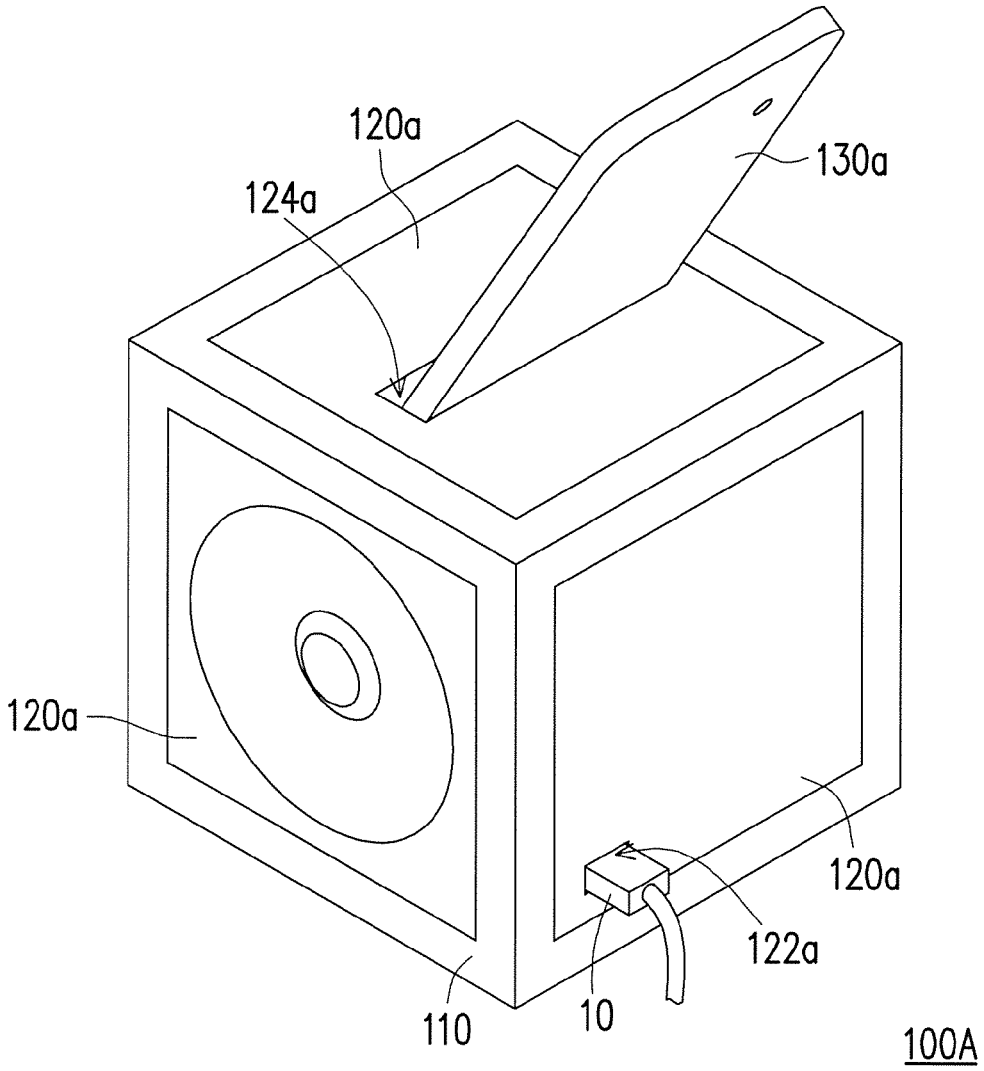
FIG. 4B is a schematic view of the assembled frame structure of FIG. 4A from another aspect.

FIG. 4B is a schematic view of the assembled frame structure of FIG. 4A from another aspect. Referring to FIG. 4B, one of the covers 120*a* around the plug-in 130*a* is a speaker, for example, for playing the audio outputted from the plug-in 130*a* (i.e. the smart phone, tablet computer, or portable music player). In addition, another cover 120*a* around the plug-in 130*a* may have a connection port 122*a*. An external line 10 may be connected with the connection port 122*a* for transmitting a signal or supplying power to the plug-in 130*a* (i.e. the smart phone, tablet computer, or portable music player) or other covers 120*a*. Specifically, after the signal or power is transmitted to the cover 120*a* to which the external line 10 is connected through the external line 10, the cover 120*a* converts the signal or power from a wired signal to a wireless signal to be transmitted to the plug-in 130*a* (i.e. the smart phone, tablet computer, or portable music player) or other covers 120*a* by wireless transmission. In another embodiment, the external signal or power may also be transmitted by wireless transmission, so as to eliminate the need to connect the external line 10 to the cover 120*a*.

In conclusion, the assembled frame structure of the invention includes the hollow frame as the main body for the user to assemble multiple covers according to his/her needs, so as to form a multi-function package module. Specifically, the user may assemble covers that have different functions to the hollow frame according to the operation requirements, or assemble covers that have different shapes to the hollow frame according to appearance requirements. Therefore, the assembled frame structure of the invention is easy to assemble/disassemble and is highly flexible for assembly and use.

In addition, at least one of the covers is provided with the assembling opening for detachably plugging in a plug-in. For example, the plug-in may be a cup, a pot, a fish tank, parts of a doll, such as head, hands, and legs, a smart phone, a tablet computer, or a portable music player according to the user's needs or interest. The user may also assemble covers having certain functions or shapes to the hollow frame corresponding to the functions or purposes of the plug-in.

It will be apparent to those skilled in the art that various modifications and variations can be made to the disclosed embodiments without departing from the scope or spirit of the invention. In view of the foregoing, it is intended that the invention covers modifications and variations of this disclosure provided that they fall within the scope of the following claims and their equivalents.

What is claimed is:

1. An assembled frame structure, comprising:

a hollow frame having a plurality of first assembling openings, wherein the hollow frame is an integrally formed structure;

a first set of covers adapted to be detachably assembled to the hollow frame through the first assembling openings respectively, so as to form the assembled frame structure into a first multi-function package module; and a second set of covers adapted to be detachably assembled to the hollow frame through the first assembling openings respectively, so as to form the assembled frame structure into a second multi-function package module different from the first multi-function package module, wherein the first set of covers and the second set of covers are replaceable with each other, and each cover in the first set of the covers and the second set of the covers is adapted to be fixed to the hollow frame through magnetic force.

2. The assembled frame structure according to claim 1, wherein at least one of the covers in the first set of the covers or the second set of the covers has at least one second assembling opening, and the assembled frame structure further comprises at least one plug-in that is detachably assembled to the corresponding cover through the at least one second assembling opening.

3. The assembled frame structure according to claim 1, wherein the hollow frame comprises a plurality of magnetic sensitive members located in the first assembling openings while each cover in the first set of the covers and the second set of the covers comprises a plurality of magnetic members, and when the cover is detachably assembled to the hollow frame through the corresponding first assembling opening, the magnetic members of the cover respectively attract the magnetic sensitive members located in the corresponding first assembling opening.

4. The assembled frame structure according to claim 1, wherein the hollow frame comprises a plurality of magnetic members located in the first assembling openings while each cover in the first set of the covers and the second set of the covers comprises a plurality of magnetic sensitive members, and when the cover is detachably assembled to the hollow frame through the corresponding first assembling opening, the magnetic sensitive members of the cover are respectively attracted to the magnetic members located in the corresponding first assembling opening.

5. The assembled frame structure according to claim 1, wherein each cover in the first set of the covers and the second set of the covers has a first surface and a second surface opposite to the first surface, and when the cover is detachably assembled to the hollow frame through the corresponding first assembling opening, the first surface is hidden in the hollow frame while the second surface is exposed outside the hollow frame.

6. The assembled frame structure according to claim 5, wherein at least one of the covers in the first set of the covers comprises a grip part disposed on the second surface.

7. The assembled frame structure according to claim 5, wherein the second surface of at least one of the covers in the first set of the covers and the second set of the covers is printed with text, an image, a symbol, or a mark, or comprises a digital display panel.

8. The assembled frame structure according to claim 5, wherein at least one of the covers in the second set of the covers comprises a carrying part disposed on the second surface.

9. The assembled frame structure according to claim 1, wherein at least one of the covers in the first set of the covers comprises a main part and a covering part connected with the main part, and the covering part is adapted to move relative to the main part to expose or cover a receiving space of the main part.

* * * * *